US005430918A

United States Patent [19]

Cocker

[11] Patent Number: 5,430,918

[45] Date of Patent: Jul. 11, 1995

[54] WARPER DELIVERY SYSTEM HAVING CONSTANT DELIVERY ANGLE

[76] Inventor: John Cocker, Box 297, Clover, S.C. 29710

[21] Appl. No.: 219,634

[22] Filed: Mar. 29, 1994

[51] Int. Cl.[6] ..... F26B 13/12; D02H 13/00; B65H 63/00

[52] U.S. Cl. ..... 28/185; 242/615.1

[58] Field of Search ..... 28/185, 186, 190, 194; 242/431.15, 615.1, 18 R, 47

[56] References Cited

U.S. PATENT DOCUMENTS

| | | | |
|---|---|---|---|
| 1,366,100 | 1/1921 | Rhoades | 28/185 |
| 3,101,747 | 8/1963 | Hindle | 139/109 |
| 3,163,914 | 1/1965 | Kimpton | 28/185 |
| 3,440,700 | 4/1969 | Berridge | 28/185 |
| 3,596,682 | 8/1971 | Nydam | 242/186 |
| 3,963,187 | 6/1976 | Ohi | 242/615.1 X |
| 4,480,798 | 11/1984 | Robinson et al. | 242/18 R |
| 4,819,310 | 4/1989 | Beerli et al. | 28/185 |
| 4,890,368 | 1/1990 | Schewe | 28/185 |
| 5,107,574 | 4/1992 | Beerli et al. | 28/191 |

FOREIGN PATENT DOCUMENTS

| | | | |
|---|---|---|---|
| 792706 | 1/1936 | France | 28/185 |
| 2086285 | 12/1971 | France | 28/185 |

*Primary Examiner*—John J. Calvert
*Attorney, Agent, or Firm*—Austin R. Miller

[57] ABSTRACT

A method and apparatus for delivering a warp sheet onto a beam which includes a pickup beam on which the warp sheet is wound, a delivery device which is spaced apart from the beam for delivering the warp sheet at an angle, a detecting device for detecting any incremental change of angle of the warp sheet as it is delivered onto the beam and a control device which is connected to the detecting device to relatively move the delivery means or the beam in response to any change of angle to maintain a substantially constant angle between the beam and the warp sheet being wound thereon.

8 Claims, 4 Drawing Sheets

WARPER DELIVERY SYSTEM HAVING CONSTANT DELIVERY ANGLE

BACKGROUND OF THE INVENTION

1. Field of the Invention

The present invention relates to an apparatus for the delivery of materials onto a beam, wherein the tension of the warp sheet being delivered and the delivery angle of the warp is controlled.

2. Description of the Prior Art

In conventional systems for delivering a warp sheet onto a beam, such as warping sheets of yarns on a loom beam, yarn is fed through a creel to a delivery roll and delivered onto the beam. Control of the tension and angle of the warp sheet being fed onto the beam was accomplished by bringing the delivery roll close to the beam, providing maximum contact and hence control of the warp sheet. U.S. Pat. No. 4,819,310 shows such an apparatus. This device provides good control over the tension of the warp sheet when the width of the sheet is small and the diameter of the pickup beam is large, as in traditional silk system warpers.

Today, however, large section beamers are used to densely pack large warp sheets, often containing yarns of virtually zero elasticity, onto small diameter beams. Section beamers are capable of running significantly greater lengths of yarn onto the beam, resulting in a much greater diameter of the wound beam. Higher tension is required to reduce the number and degree of slack ends and to more densely pack yarn onto the beam. This is particularly important in the yarns of virtually zero elasticity, such as glass, Kevlar or Nomex.

In conventional warper systems the delivery roll is positioned close to the pickup beam and able to move laterally with respect to the beam to control the tension and delivery angle of the warp. Conventional systems cannot be used effectively in today's large section beamers due to the use of yarns of low elasticity, great variation in the delivery angle based on the beam diameter and the need for higher tension to more densely pack yarn onto the beam.

Systems have therefore developed in which the delivery roll is spaced apart from the pickup beam to reduce these problems. These newer systems can accommodate the higher tension requirements of large section beamers. Also, the delivery roll can be wider than the pickup beam, allowing the width of the warp sheet to be adjusted during winding. Spacing the delivery roll away from the pickup beam also allows an operator to more easily observe the warp sheet and detect defects. However, these systems have the substantial disadvantage of great variations in the tension of the warp sheet, due to variations in the delivery angle of the sheet being delivered onto the pickup beam.

An example of such a system used in the prior art is shown in FIG. 1. Warp sheet 1 is fed to calendar roll 8 and over delivery roll 2 and delivered onto pickup beam 3. As warp sheet 1 is fed onto pickup beam 3 the pickup beam diameter 4 increases outward toward pickup beam flange 5. This increase in diameter causes the delivery angle of the sheet to change by an angle $\theta_1$ as warp sheet 1 moves from position 6 to position 7. The change in delivery angle $\theta_1$ causes variations in the sheet tension producing fluctuation in the density of yarn packed onto the pickup beam. When using yarns of low elasticity changes in density can result in great damage to the yarn when it is wound off the beam. The variation in delivery angle $\theta_1$, will also cause the warp sheet 1 to apply pressure to delivery roll 2 resulting in a pinching action of delivery roll 2 against calendar roll 8. This can cause severe damage to the warp sheet and possibly the warping system itself.

OBJECTS OF THE INVENTION

Therefore, it is an object of the present invention to provide a warp sheet delivery system capable of controlling the warp sheet tension and delivery angle of the warp sheet being delivered from a delivery roll to a large diameter pickup beam.

Other objects of the present invention will become apparent to those of ordinary skill in the art from the following description, the drawings and the appended claims.

While a preferred embodiment of the invention has been chosen for the purpose of illustration and description, it is not intended to be exhaustive or limit the scope of the present invention, which is defined in the appended claims.

DETAILED DESCRIPTION OF THE INVENTION

Figure 1:
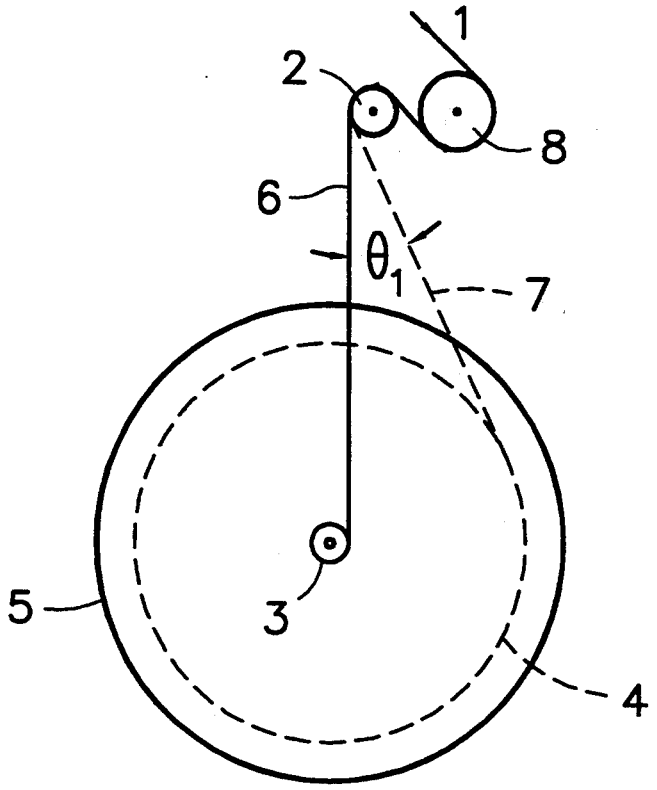
PRIOR ART Fig. 1
FIG. 1 is an elevational view of a conventional warp sheet delivery system for large diameter pickup beams.
Figure 2:
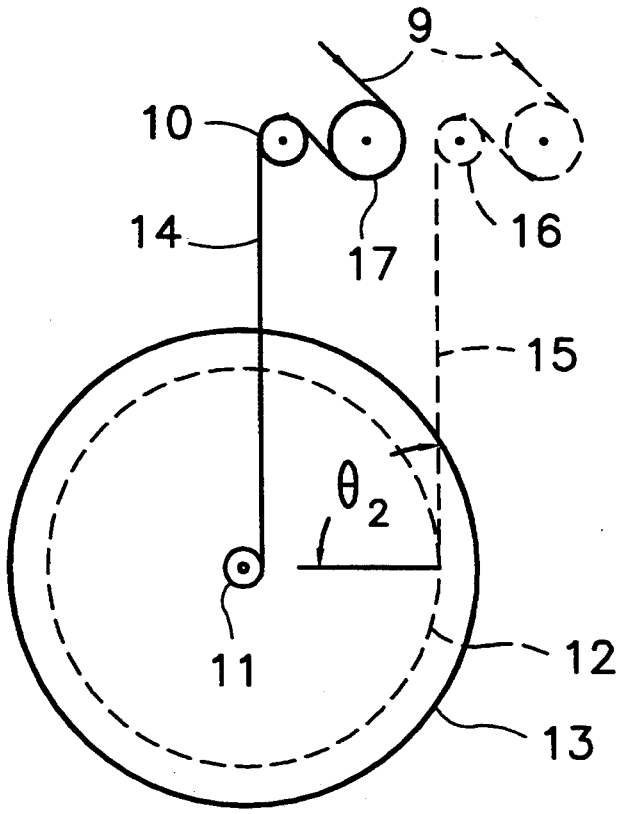
FIG. 2 is an elevational view of a preferred embodiment of the invention in simple form.

Referring now to the drawings, FIG. 2 illustrates a preferred embodiment of the invention whereby warp sheet 9 is fed in a conventional manner around calendar roll 17, feeding delivery roll 10. Delivery roll 10 then delivers warp sheet 9 to pickup beam 11 in standard fashion, starting at position 14. As warp sheet 9 is wound onto pickup beam 11, the pickup beam diameter 12 increases outward toward the periphery of pickup beam flange 13. As pickup beam diameter 12 increases, delivery roll 10 is moved in response to such increase, by means to be described in further detail hereinafter, to delivery roll position 16 causing the warp sheet to move gradually from warp sheet position 14 to warp sheet position 15 when the diameter of the beam is at pickup beam diameter 12. This allows for pickup angle $\theta_2$ to remain constant (at 90° for example) throughout the warping operation.

Warp sheet 9 may be formed in any conventional manner, such as removing yarns from bobbins on a warp creel, supplying these yarns to a reed which orders the yarn, forming the warp sheet, or otherwise. Warp sheet 9 may be fed around calendar roll 17 and delivery roll 10 or otherwise. Calendar roll 17 and delivery roll 10 are supported conventionally, such as by a mechanical carriage, so long as the support of calendar roll 17 and delivery roll 10 is movable to allow them to be moved as a unit in reaction to the increase in pickup beam diameter 12, maintaining constant angle $\theta_2$ at 90° or any other preselected substantially constant angle.

Figure 3:
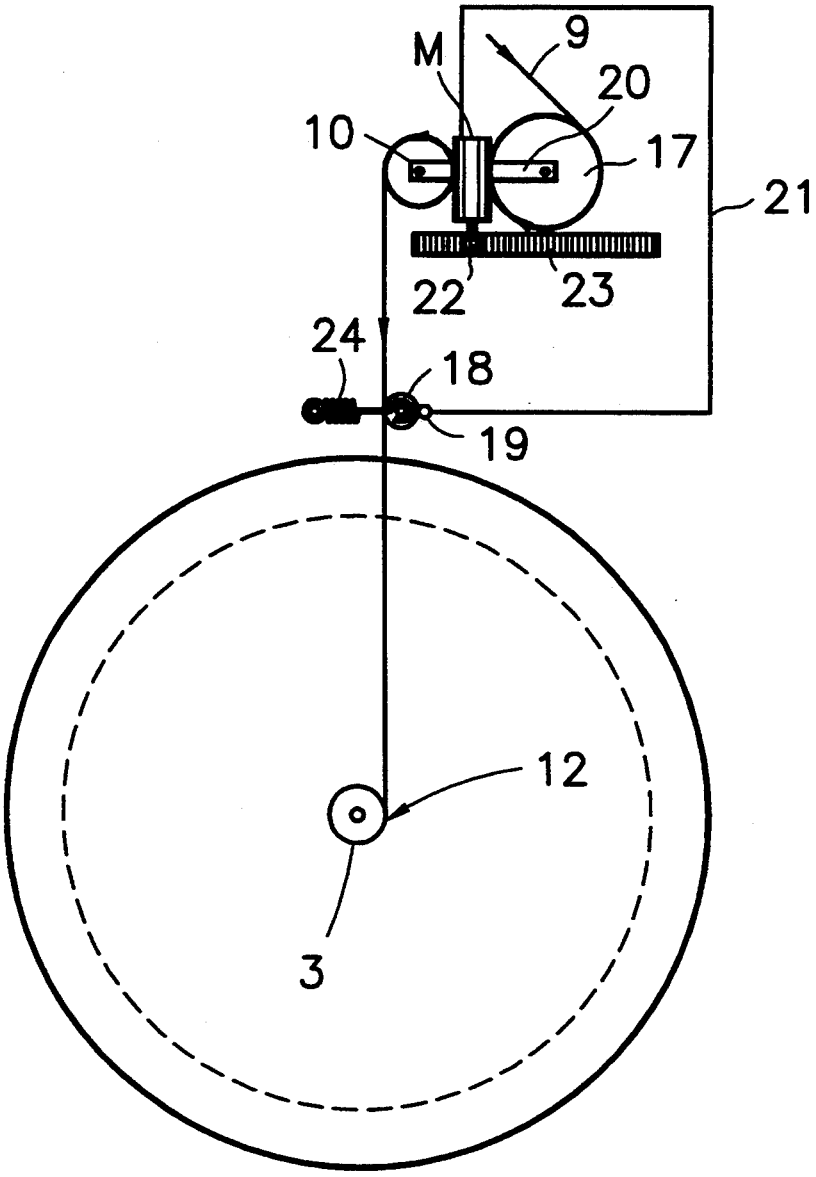
FIG. 3 is an elevational view of a detection system for detecting changes in warp sheet tension.

In a preferred embodiment of the present invention, calendar roll 17 and delivery roll 10, mounted on a common frame 20, can be connected to react to the increase in pickup beam diameter 12 by using a press roll 18 as shown in FIG. 3. Warp sheet 9 is fed to calendar roll 17, in turn feeding delivery roll 10. As the tension on warp sheet 9 slightly increases from the increase in pickup beam diameter 12, warp sheet 9 presses slightly against press roll 18. Press roll 18 then closes contact switch 19 by touching it. Contact switch 19 then, through wire 21, energizes a motor M that rotates a gear 22 geared to a rack 23 and moves calendar roll 17 and delivery roll 10 to the right as a unit. A counter tensioning device such as a spring 24 is attached to press roll 18. As press roll 18 moves to the right, the desired equilibrium tension of warp sheet 9 is re-established and press roll 18 no longer touches contact switch 19. Contact switch 19 then de-energizes the motor M, momentarily stopping the movement of delivery roll 10 and calendar roll 17. Then, stepwise in small increments, the delivery roll 10 moves in response to increase of diameter.

The movement of delivery roll 10 and calendar roll 17 in reaction to the increase in diameter of the pickup beam advantageously allows for great control over the tension and delivery angle of warp sheet 9. A desired tension or change in tension can be effected by the selection of the counter tensioning device connected to press roll 18. For example, the tension of warp sheet 9 can be gradually reduced as the beam diameter increases, allowing for a graded decrease in density of the wound sheet.

Figure 4:
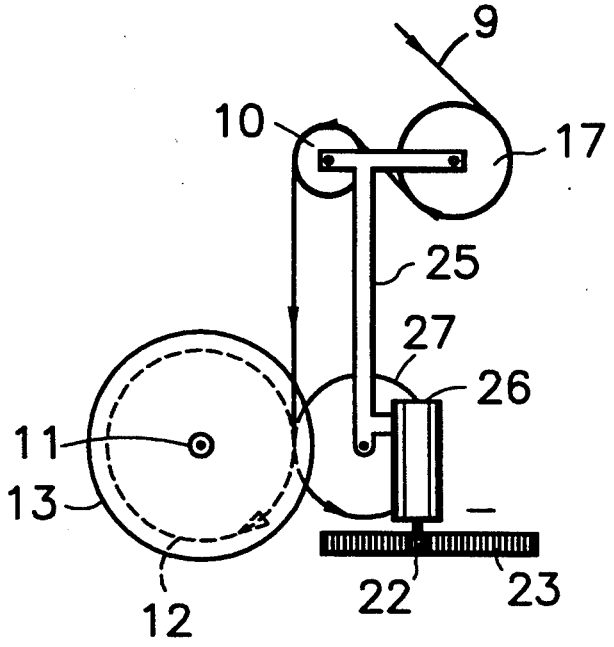
FIG. 4 is an elevational view of another preferred embodiment of the invention.
Figure 5:
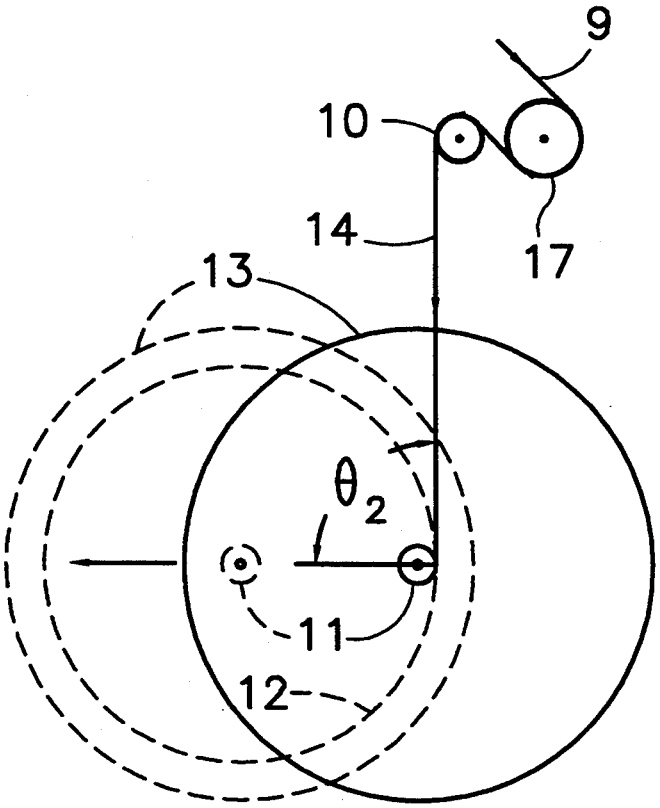

FIG. 4 illustrates another preferred embodiment of the present invention whereby delivery roll 10 and calendar roll 17 are fixed in relation to presser roll 27 via mechanical linkage 25. Linkage 25 is also connected to positioning means 26 which includes a motor and pressure sensing mechanism for detecting the pressure exerted upon presser roll 27 as the diameter of pickup beam 11 increases. This sensing mechanism may be the same as that depicted in FIG. 3, namely the use of a contact switch and counter tensioning device or otherwise. The entire assembly of presser roll 27, delivery roll 10 and calendar roll 17 will then move stepwise in small increments in response to this increase in diameter. Alternatively, it is possible for this assembling to remain fixed while pickup beam 11 moves outward.

To maintain a desired constant angle of travel of the whole warp sheet between the last point of fixed contact and the pickup beam, the rotating center of pickup beam 11 must move away from the delivery roll and presser roll, or they must move away from it. Thus, pickup beam 11 could be mounted in such a way to permit it to move horizontally to or from presser roll 27, or presser roll 27 could be mounted on a common frame within the overall beamer assembly to move horizontally to or from pickup beam, maintaining a constant tension angle.

This provides great advantages in warper systems in which one beamer is put in front of several creels and as one creel is being run on pickup beam 11, the others are being reloaded. Since presser roll 27 and the delivery system are fixed, the warper system can be set up so that pickup beam 11 could back off as it filled up or the presser roll and delivery system being in their own independent frames could back off as the beam filled.

This invention is to be sharply distinguished from the original system for putting up yarns in small amounts or short lengths. In preparation for winding on a loom beam for slashing, the creels were small ones with perhaps 30, 40, or maybe 120 ends, not magazined, and the packages were very small, so the lengths were very short. The yarn was wound on a very large diameter drum, perhaps three to four feet in diameter, which was also quite long. The warp sheet coming from the creel was quite narrow as it had so few ends in it and didn't run very long as the package was very small. The width of the warp sheet might be anywhere from 2" to 6" in width and quite often the total winding of each bout added only a couple of inches to the total overall diameter of the big drum. As this bout built up, the warp was traversed to the side to start another bout, and so on to achieve the total yardage of construction of warp desired. This system is still used today in some small mills that require only short runs and a wide variation of warp packages.

The drum or barrel on which the yarn is wound has no heads or flanges. Therefore the roll or comb or reed delivering the small, narrow, warp sheet can be brought in closely to the barrel for traversing purposes and this device can easily be set up to move both right and left as well as in and out so as to retain the same angle of departure and arrival of the yarn on to the beam at all times under most conditions. This warping operation is generally very slow, especially in comparison to today's large section beamers.

As a rule, even without a device as described above, the angle change would be insignificant and as a rule, the tensions applied to the ends as they are being wound in the "Silk System" in "bouts" are generally very considerably less than those encountered today. The higher tensions used today are not only used to reduce the number and degree of slack ends but also to pack more yarn on to the beam. This is particularly important in yarns of virtually zero elasticity, such as glass, "Kevlar," "Nomex," etc. Additionally, this system is also extremely necessary in warping systems where a very low tension is required in laying the fibers on the beam. For example, Spandex, Lurex, Lycra, core type wound yarns, and some very fine count cottons are, in some instances, almost fed to the beam. In short, where a constant tension is required, it is most necessary to eliminate as many uncontrolled variables that would change it, as possible.

It is important to consider now the standard section beam warping operation today. A large number of ends, such as four hundred to fifteen hundred, of all types of fibers, both natural and synthetic, are wound on a beam. These beams are generally 54" wide but a few are wider, and the flange diameters are at least 21" but the majority are from 30" up to 40", with barrel diameters as small as 10". In a case of a beam of 10" barrel by 40" head the operator is confronted with a build up ratio of 4 to 1. There is a great angle variation. The final device in contact with the yarn at this point is generally a roll, though it can be a reed or comb. Both are wider than the beam so that the width of the warp sheet can be controlled to a fine degree as regards its relationship to the location of and proximity to the beam flange, and as the flange deflects out from pressure as the beam diameter increases, the width of the yarn sheet can be adjusted to compensate for this change.

As will be appreciated in this type of beaming operation, which is by far the large majority of beaming operations today, the delivery roll cannot be narrower than the beam as it can in a silk system operation. In this type of operation the roll is fixed so that as the beam diameter increases, so does the angle of departure and arrival from the roll to the beam itself. As it does, the tension on the warp may also vary considerably from the original setting when the beam was empty, because the axes of the beam and the delivery roll are fixed in their positions. This type of tension control and need for such control is not a problem in the silk system of beaming due to the limited length of runs, width of the bout and low tension requirements. There is little likelihood of damage to the beam of yarn in the silk system from lack of tension control as there is in the standard section beam warping system.

It has now been discovered that continuous, constant, consistent angle of the yarn from its departure from the delivery roll or the reed until its arrival at the beam, during the entire length of windup, is paramount to consistent, accurate, repeatable quality beams. This flexibility also permits the design of the delivery roll system to allow for a far more accurately monitored and controlled strain gauge indicator and/or loading system to also ensure consistent repeatability in quality beams.

Changing of angle of the yarn during build up harmfully alters the yarn tension; no matter what the roll support design may be, it will have an unpredictable, variable effect on yarn tension which is virtually impossible to compensate or correct with any reasonable degree of accuracy.

It has been generally a common sense rule of thumb, going back over the years that the more support the yarn has, the more control over it the operator may have. Therefore it made sense for the original designers of silk systems to place the last contact with the delivery system of the yarn as close to the yarn as possible. This gave them control. This is not possible on today's system. However, according to this invention the variable positioning of the feed roll to maintain a constant feed angle eliminates one more uncontrollable variable in maintaining essentially constant yarn tension from last contact to the actual windup on the beam.

The present invention also provides the benefit of allowing easy observation of the warp sheet to detect defects without variation in warp sheet tension or delivery angle since delivery roll 10 is spaced apart from pickup beam 11 and a desired tension is maintained by moving delivery roll 10, in relation to the increase in pickup beam diameter 12 to maintain a constant delivery angle.

While the present invention has been disclosed in terms of the preferred embodiment in order to facilitate better understanding of the invention, it should be appreciated that the invention can be embodied in various ways without departing from the principle of the invention. The use of a gear and rack is only one of many expedients that may be used to move the feed roll or rolls in response to buildup on the beam, or even to move the beam relative to the feed rolls. In some cases the control can be effected by simply counting the number of revolutions of the feed roll and moving the feed roll or beam in response to the count. The warp sheet may be fed over only one roll, many rolls or directly from a reed or guide eye when being delivered to the pickup beam. Any counter tensioning device connected to the press roll, if any, may be mechanical, hydraulic or otherwise. Additionally, the movement of the feed rollers may be effected by a purely mechanical linkage or by electrical action, or hydraulically between press roll 18 and the feed rolls. Further, the device for detecting changes in warp sheet tension may be by other than a press roll, such as by use of a load cell to measure tension or otherwise. Therefore, the invention should be understood to include all possible embodiments and modifications which can be embodied without departing from the spirit and the principles of the invention as set out in the appended claims.

I claim:

1. In an apparatus for delivery of a warp sheet onto a beam, the combination which comprises:

a pickup beam on which the warp sheet is wound;

a delivery means spaced apart from said beam for delivering said warp sheet to said beam at a delivery angle measured between said wrap sheet and an axis of said pickup beam from the center to the tangential point of contact of said warp sheet;

detecting means for detecting an incremental change of said delivery angle of said warp sheet being delivered to said beam; and control means connected to said detecting means for relatively moving said delivery means or said beam in response to said change of angle, said control means being constructed and arranged for keeping said delivery angle substantially constant.

2. The apparatus defined in claim 1, wherein said delivery means comprises a calendar roll and a delivery roll mounted on a common support.

3. The apparatus of claim 2, wherein said common support comprises a gear and rack assembly.

4. The apparatus defined in claim 1, wherein said means for detecting changes of angle includes a press roll positioned to contact said warp sheet.

5. The apparatus defined in claim 1, wherein said control means includes a contact switch connected to a moving means for energizing said moving means to move said delivery means.

6. The apparatus defined in claim 1, wherein said delivery means is at least as wide as said beam.

7. The apparatus defined in claim 1, wherein said delivery means, said detecting means and said control means are mounted on a common support.

8. A method for the delivery of a warp sheet onto a beam comprising the steps of:

delivering said warp sheet at an angle measured between said wrap sheet and an axis of said beam from the center to the tangential point of contact of said wrap sheet onto said beam from a delivery means spaced apart from said beam;

detecting an incremental change of angle of said warp sheet as it is being delivered onto said beam:

relatively moving said delivery means or said beam in response to said change of angle in order to maintain a substantially constant angle between said beam and said warp sheet being wound thereon.

* * * * *

UNITED STATES PATENT AND TRADEMARK OFFICE

CERTIFICATE OF CORRECTION

PATENT NO. : 5,430,918

DATED : July 11, 1995

INVENTOR(S) : John Cocker

It is certified that error appears in the above-indentified patent and that said Letters Patent is hereby corrected as shown below:

Column 6, line 27, after "of" insert --said delivery--.

Signed and Sealed this

Twelfth Day of September, 1995

*Attest:*

Bruce Lehman

BRUCE LEHMAN

*Attesting Officer*

*Commissioner of Patents and Trademarks*